United States Patent [19]

Erickson

[11] Patent Number: 4,927,478

[45] Date of Patent: May 22, 1990

[54] METHOD AND APPARATUS FOR FLETCHING ARROWS

[76] Inventor: Duane Erickson, 3170 S. 10th East, Salt Lake City, Utah 84106

[21] Appl. No.: 352,027

[22] Filed: May 15, 1989

[51] Int. Cl.[5] ..... B65H 81/00; B32B 31/00

[52] U.S. Cl. ..... 156/185; 156/191; 156/249; 156/443

[58] Field of Search ..... 156/61, 184, 185, 187, 156/191, 247, 249, 443

[56] References Cited

U.S. PATENT DOCUMENTS 2,711,382 6/1955 Smith-Johannsen ..... 156/227

3,749,623 7/1973 Benoit ..... 156/187

*Primary Examiner*—William A. Powell

[57] ABSTRACT

A method and apparatus for fletching arrows wherein fletching guides are positioned adjacent an end of an arrow shaft and feathered or simulated feather fletchings are positioned on the shaft in accordance with the fletching guides; with the fletchings being integral with the fletching guide or attachable thereto with contact adhesives on edges of the fletchings.

8 Claims, 2 Drawing Sheets

METHOD AND APPARATUS FOR FLETCHING ARROWS

BRIEF DESCRIPTION OF THE INVENTION

1. Field of the Invention

This invention relates to archery and is particularly concerned with a method and apparatus for fletching arrows.

2. Prior Art

The need for good fletching on arrows has been recognized for about as long as bows and arrows have been used. In the past proper fletching of an arrow has required a considerable amount of training and skill. Usually such fletching is performed with vanes made from feathers, but more recently simulated feather vanes have been proposed and on occasion solid plastic vanes have been used. So far as I am aware, however, all of these previously known vanes have been individually installed on an arrow shaft. At the present time this is usually done by placing the arrow shaft and the vanes in clamping members of jigs, applying an adhesive to the shaft and/or the vane and then clamping the vane to the shaft until the adhesive has set up. This fletching procedure, in addition to requiring a considerable amount skill in the setting up of the jigs for use on arrow shafts of different outside diameters, takes a great deal of time and as a result thereof it is rather costly.

SUMMARY OF THE INVENTION

Principal objects of the present invention are to provide a fletching system that can be performed even by unskilled persons, that is very inexpensive, that can be performed at any location, such as a factory, a retail shop, at home, or even in the field, and that will provide fletching that is at least equal to previously known fletching, insofar as aerial flight characteristics are concerned.

Principal features of the invention includes the application of the fletching guides to an arrow shaft and the application of vanes as provided by the fletching guides. The vanes may be integrally formed with a fletching guide or may be separate, with contact adhesive on the shaft engaging edge of a vane.

Principal features of one embodiment of the invention include a fletching guide in the form of a backing member or sheet that may be of any desired length and that has equally spaced rows of integral vanes projecting from one face thereof. The vanes are tapered from large portion and may be curved throughout their length so that when they are wrapped around an arrow shaft they form a spiral around the shaft. In addition, the vanes may be curved so that when they are wrapped around the arrow shaft they curl in a direction corresponding generally to the curvature of the shaft. It is sometimes preferred that a great many vanes be provided and that they be closely spaced together, so that a more equal vane spacing can be provided, regardless of the size of the arrow shaft used.

The backing member or sheet preferably has a coating of adhesive material on the side opposite the vanes and in this preferred form a removable protective sheet is applied over the adhesive material to protect it prior to the time it is peeled away and the backing sheet is used to fletch an arrow shaft.

The fletching guides applied to an arrow shaft may also be in the form of a section of a pre-printed tape. The tape is made in widths corresponding to the length of shaft-engaging edges of vanes to be applied. Each section length is made to coincide with an arrow shaft circumference and line markings are equally spaced so that when a section is wrapped around a shaft the line markings are equally spaced around the shaft and are parallel the longitudinal axis of the shaft.

In the embodiment of FIG. 13, the fletching guides comprise line markings equally spaced around the end of a shaft and provided by inking, painting, etching or the like. In either the embodiment of FIGS. 9–12 and 13 vanes are formed of feathers, simulated feathers, or other materials and shapes. Each vane has a shaft engaging edge that is coated with a contact adhesive and with the adhesive covered by a tear away protective covering once the line markings are applied to the shaft a protective covering is pulled off each vane to be attached and a vane is pressed against and on line with a line marking.

Additional objects and features of the invention will become apparent from the following detailed description, taken together with the accompanying drawings showing a presently preferred embodiment of the invention.

THE DRAWINGS

In the drawings:

FIG. 1 is a perspective view, taken from above, of one embodiment of a fletching guide comprising a pre-fletched tape of the invention;

FIG. 2, an end view of an arrow shaft to which the pre-fletched tape of FIG. 1 has been attached;

FIG. 3, a view like FIG. 2, but showing the pre-fletched tape to have a different vane spacing;

FIG. 4, a view like FIG. 1, but showing another embodiment of pre-fletched tape;

FIG. 5, a view like FIG. 2, but showing the pre-fletched tape of FIG. 4;

FIG. 6, another view like that of FIG. 5, but showing another spacing of the vanes of the pre-fletched tape of FIG. 4;

FIG. 7, a view like FIG. 1 but showing still another embodiment of the pre-fletched tape of the invention;

FIG. 8, a view like that of FIG. 2, but showing the pre-fletched tape of FIG. 7;

FIG. 9, a perspective view of a pre-marked tape used to provide a fletching guide;

FIG. 10 a removal section of the pre-marked tape of FIG. 9;

FIG. 11, a perspective view of a fragmentary arrow shaft with the pre-marked tape attached to the shaft and the vanes shown exploded away from the shaft;

FIG. 12, an enlarged view of a vane of FIG. 11; and

FIG. 13 an enlarged view of an arrow shaft (shown fragmentarily) with line marking affixed directly to the shaft.

DETAILED DESCRIPTION

Figure 1:
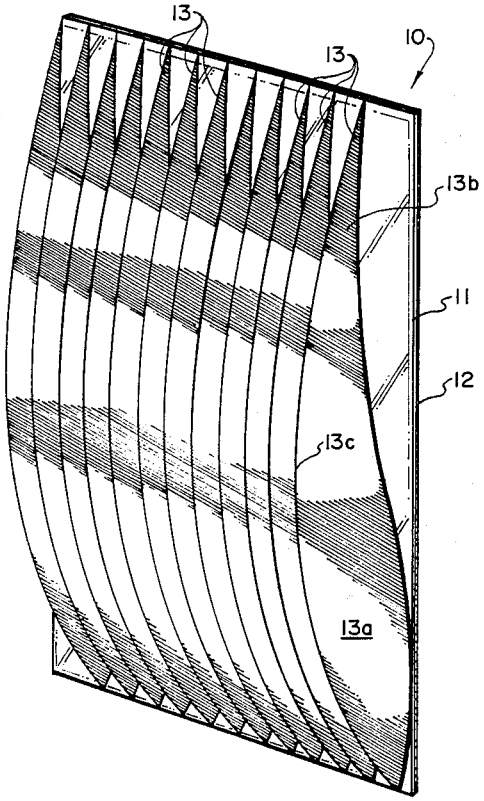
Figure 4:
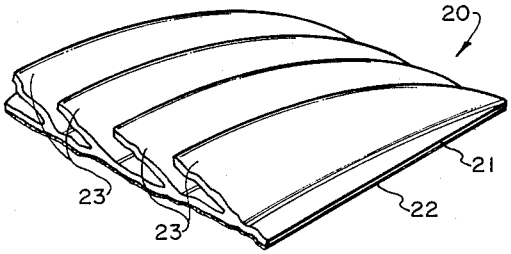
Figure 2:
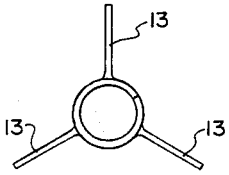
Figure 3:
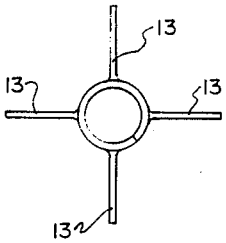

Referring now to the drawings:

In the illustrated embodiment of FIGS. 1–3, there is shown a fletching guide comprising pre-fletched tape that includes a backing member or sheet 10, preferably made of flexible plastic or the like having an adhesive 11 on one face thereof. A protective sheet or covering 12 fits over the adhesive material to protect it against drying out, dirt, or the like until the tape is to be used. Parallel, equally spaced vanes 13 project from the other face of the sheet 10. Each vane 13 has an enlarged portion 13*a* adjacent one side of the backing sheet and is tapered to the other side of the backing sheet at 13*b*. The enlarged portion 13*a* is also preferably curved at 13*c* to the adjacent tape edge. As shown in FIGS. 1–3, the vanes project straight out from the backing sheet 10 and extend straight across the backing sheet. In use, the backing sheet is cut into lengths corresponding to the circumference of the arrow shaft to be fletched. This may provide three vanes, as shown in FIG. 2, equally spaced around the arrow shaft or, it may provide four or more such vanes equally spaced around the arrow shaft, as shown in FIG. 4. The number of vanes per shaft will, of course, be determined by the spacing between the vanes on the backing sheet.

Figure 5:
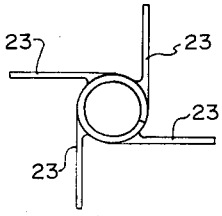
Figure 6:
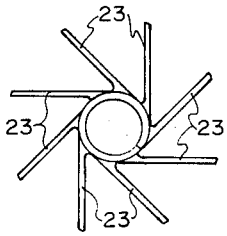

FIGS. 4–6 show another embodiment of a fletching guide using a pre-fletched tape. As shown in FIGS. 4–6 a backing sheet 20 (corresponding to the previously described backing sheet 10) is provided. One surface of the backing sheet 20 is coated with an adhesive 21, and as in the manner previously described, a protective sheet 22 is placed over the adhesive. The principal difference between the pre-fletched tape 20 of FIGS. 4–6 and the pre-fletched tape 10 of FIGS. 1–10 is that in the embodiment of FIGS. 4–6 the vanes shown generally at 23 do not project normal to the backing sheet 20 but, rather, project at an angle therefrom such that each vane overlies the next adjacent vane in the direction in which the vanes extend. Thus, when the pre-fletched vane of FIGS. 4–6 is used, the vanes extend substantially tangential from the arrow shaft, as shown best in FIGS. 4–6. The number of tangential extending vanes, will be determined by the spacing of the vanes on the backing sheet 20 and may be four, as shown in FIG. 5, or more than four, as shown in FIG. 6.

Figure 7:
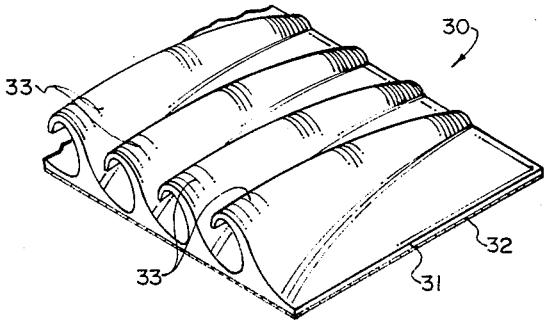
Figure 8:
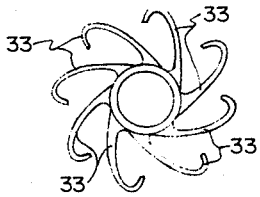
Figure 9:
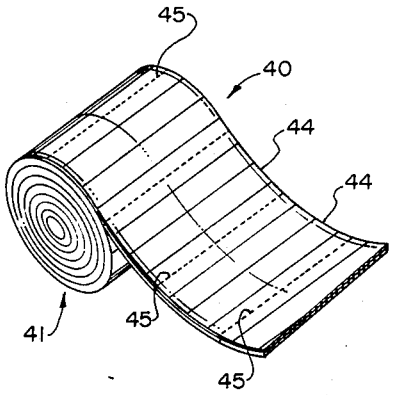

In FIGS. 7 and 8, there is shown still another fletching guide of the invention, having a pre-fletched tape. In this embodiment, the tape has a backing sheet 30, similary to the backing sheets 10 and 20 previously described, and including an adhesive coating 31 on one surface thereof. A protective backing sheet 32 covers the adhesive surface to protect it, in the manner previously described. Vanes 33 project from the opposite face of the backing sheet 30 and the vanes 33 are preferably made close enough together that a large number of the vanes, i.e., nine or ten vanes, will project from an arrow shaft when the backing sheet is attached thereto. Vanes 33 extend parallel to one another and are curved across the backing member 31 such that when they are installed on a shaft they will form a spiral around the shaft. In addition, each of the vanes 33 is preferably curled, with the vanes all being curled in the same direction such that when they are installed on the arrow shaft, as shown in FIG. 8, they will extend outwardly from the shaft and will all curve in the same direction around the shaft. With the method of installation of the backing sheet on an arrow shaft, it is a simple matter to position even the spiraled and curled vanes of FIGS. 7 and 8.

It is well recognized in the archery profession that the larger diameter of the arrow shaft the more feather that is required to make the arrow fly properly. With the embodiments of FIGS. 1–8, where the length of backing sheet required for any particular arrow shaft is determined by the circumference of the shaft, it is possible to have an automatic compensation in the amount of "feather" that is used for any arrow shaft. This is because the number of vanes will change, depending upon the length of backing sheet used. In the embodiment shown in FIGS. 1–6, it is generally necessary that the vane spacing be predetermined to provide even spacing of the vanes when the backing sheet has been installed on a arrow shaft. In the embodiment of the invention shown in FIGS. 7 and 8, the vanes are positioned so close together that very little, if any, irregularity in spacing will occur between the first and last vanes, even if arrow shafts of different sizes are used. In practicing the method of the invention it is only necessary to cut the desired strip of backing sheet, strip away the protective covering over the adhesive on the backing strip, and tape the backing sheet to the arrow shaft at a desired location. There are no requirements for special equipment, such as clamps, or the like, and very little skill is required to properly fletch an arrow in accordance with the present invention.

Figure 10:
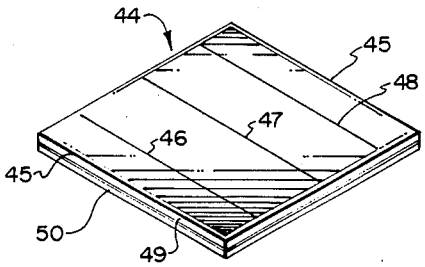
Figure 11:
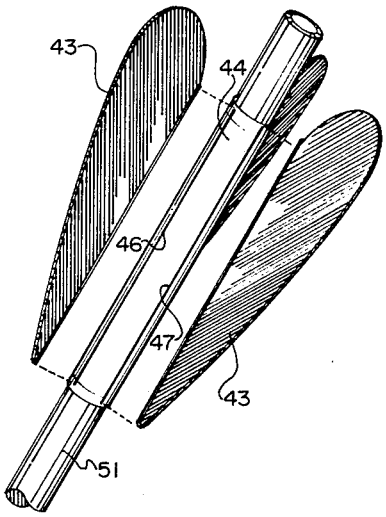

In the embodiment of the invention shown in FIGS. 9–12, the fletching guide is provided by a pre-marked tape 40 that may be formed as a continuous roll 41 of tape. The pre-marked tape is made sufficiently wide to correspond to the length of a vane 43 (FIG. 12) and is made in connected sections 44 (Fig. 10). The sections 44 are separated by a score line or a perforation 45 that allows a section to be easily removed from the roll.

Each section 44 is made just long enough to encircle an arrow shaft. Line markings 46, 47 and 48 are made parallel to one another and are spaced on one face of the tape 40 such that when the tape is wrapped around the arrow shaft the line markings are parallel to one another and the longitudinal axis of the shaft. Tape 40 has an adhesive 49 on the face thereof opposite the line markings and a protective cover 50 for the adhesive. In applying the tape to an arrow shaft 51, the cover 50 is stripped away and the section 44 is wrapped around the shaft with the line markings showing. Thereafter, a vane 43 is applied to each line marking by stripping away a protective covering 55 of the vane edge 56 and exposing of a contact adhesive 57. The vane is then attached to the shaft by pressing the edge of the vane having contact cement thereon onto a line marking. While three vanes are shown positioned in FIG. 11 and have been described it will be apparent that more vanes, equally spaced, could be used.

Figure 12:
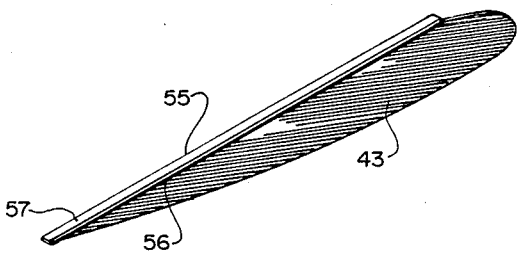
Figure 13:
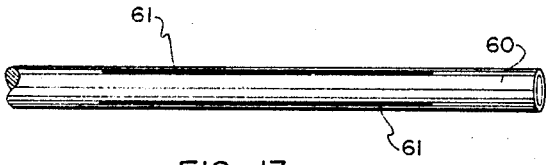

In FIG. 13, there is shown an arrow shaft 60 having line markings 61 equally spaced around the shaft and arranged to receive the vanes 43 shown in FIG. 12.

The method and apparatus herein disclosed is particularly adaptable for mass production of arrows since the apparatus is either pre-formed or made part of an arrow shaft during production thereof.

Although preferred forms of my invention have been herein disclosed, it is to be understood that the present disclosure is made by way of example and that further variations are possible, without departing from the scope of the hereinafter claimed subject matter, which subject matter I regard as my invention.

I claim:

1. A method of fletching arrows comprising the steps of applying elongate fletching guides to be equally spaced around one end of an arrow shaft; and making a fletching extend from each elongate fletching guide.

2. A method as in claim 1, further including forming the fletchings extending from each elongate fletching guide integral with the fletching guide.

3. A method as in claim 1, including forming the fletching guides on tape and wrapping a portion of tape with side guides thereon around the arrow shaft and placing contact adhesive on edges of the fletchings and then attaching said fletchings to said guides using said contact adhesive.

4. A method as in claim 1, including individually marking the fletching guides on the arrow shaft;

placing contact adhesive on edges of fletching members; and attaching each fletching member on a fletching guide using the contact adhesive.

5. Apparatus for fletching arrows comprising a fletching guide to be applied to adjacent one end of an arrow shaft extending parallel to one another and spaced equidistantly apart around the shaft; and a fletching member affixed to each of the elongate guides and extending outwardly of the arrow shaft.

6. Apparatus as in claim 5, wherein the fletching guide is formed of thin, durable plastic material; and the fletching members are integral with the fletching guide and are formed of the same material as the fletching guide.

7. Apparatus as in claim 5, wherein the fletching guide is formed of thin, durable, sheet material having elongate guides on one face thereof;

adhesive means on the other face of the fletching guide to bond the said fletching guide to an arrow shaft, whereby the elongate line guides are equally spaced around the shaft; and vanes having contact adhesive on one edge thereof, said vanes each being attached along an elongate guide by said contact adhesive.

8. Apparatus as in claim 5, wherein the fletching guide comprise elongate guides on the shaft; and vanes having contact adhesive along one edge thereof, said vanes being secure along said elongate guides.

* * * * *